US008476215B1

(12) United States Patent
Chen

(10) Patent No.: US 8,476,215 B1
(45) Date of Patent: Jul. 2, 2013

(54) DETERGENT COMPOSITION

(75) Inventor: Yi-Chen Chen, Taichung (TW)

(73) Assignee: Sheng-Chun Technology Co., Ltd., Tainan (TW)

( * ) Notice: Subject to any disclaimer, the term of this patent is extended or adjusted under 35 U.S.C. 154(b) by 0 days.

(21) Appl. No.: 13/616,876

(22) Filed: Sep. 14, 2012

(51) Int. Cl.
*C11D 1/66* (2006.01)
*C11D 3/10* (2006.01)

(52) U.S. Cl.
USPC ..... 510/252; 510/342; 510/361; 510/437; 510/488; 510/492; 510/509; 510/533

(58) Field of Classification Search
USPC ..... 510/252, 342, 361, 437, 488, 492, 510/509, 533
See application file for complete search history.

(56) References Cited

U.S. PATENT DOCUMENTS 5,364,553 A 11/1994 Cao
2010/0298199 A1* 11/2010 Ozeki et al. ..... 510/334

FOREIGN PATENT DOCUMENTS

TW 338773 8/1998

* cited by examiner

*Primary Examiner* — Brian P Mruk
(74) *Attorney, Agent, or Firm* — Hamre, Schumann, Mueller & Larson, P.C.

(57) ABSTRACT

A detergent composition includes: 11 to 45 parts by weight of a natural surfactant; 25 to 35 parts by weight of mirabilite; 10 to 40 parts by weight of a water softener; 0.2 to 5 parts by weight of a chelating agent; and a balance of an additional detergent builder.

7 Claims, 3 Drawing Sheets

(a) treated with the detergent composition of the comparative example (b) treated with the detergent composition of Example 1

(a) treated with the detergent composition of the comparative example (b) treated with the detergent composition of Example 1

(a) treated with the detergent composition of the comparative example (b) treated with the detergent composition of Example 2

(a) treated with the detergent composition of the comparative example (b) treated with the detergent composition of Example 1

(c) treated with the detergent composition of Example 2

(d) treated with the detergent composition of Example 3

DETERGENT COMPOSITION

BACKGROUND OF THE INVENTION

1. Field of the Invention

The invention relates to a detergent composition, and more particularly to a detergent composition that is for removing contaminants, such as sludge oil or greasy dirt, and that includes mirabilite.

2. Description of the Related Art

A conventional synthetic detergent is prepared by incorporating a cationic surfactant and a nonionic surfactant with a compound component such as formaldehyde, a fluorescent agent, benzene, a salt of ethylenediaminetetra acetic acid (EDTA), a phosphate, etc., so as to achieve the intended object of removing sludge oil or greasy dirt. Taiwanese Patent Publication No. 338773 discloses a nonionic surfactant that may be used in the conventional synthetic detergent contains alkyl phenol such as nonyl phenol. However, the nonionic surfactant containing nonyl phenol has a chemical structure similar to that of animal estrogen, and is also called an environmental hormone. Such environmental hormone tends to interfere with the regulatory mechanism of in vivo hormone incretion and is capable of stimulating action of the natural hormone at a relatively low concentration to directly stimulate or inhibit the incretion system of an organism so as to influence reproduction and development functions of the organism. Hence, health and propagation of the organism will be significantly and adversely affected.

Additionally, the cationic and nonionic surfactants do not satisfy international environmental protection requirements for biodegradability. These surfactants used in the synthetic detergent cannot sufficiently decompose or destroy structures of the contaminants such as sludge oil or greasy dirt intended to be removed. These surfactants generally act on transfer of the contaminants including sludge oil and greasy dirt from the object intended to be cleaned to water. When the waste water thus formed is discharged to the environment, the contaminants are still present in the waste water and result in secondary pollution of the environment and pollution of water source. Apparently, the conventional synthetic detergent having cationic and nonionic surfactants may contribute to severe pollution and destruction of the ecological environment.

SUMMARY OF THE INVENTION

Therefore, the object of the present application is to provide a detergent composition that is environmentally friendly. According to this invention, a detergent composition includes 11 to 45 parts by weight of a natural surfactant, 25 to 35 parts by weight of mirabilite, 10 to 40 parts by weight of a water softener, 0.1 to 5 parts by weight of a chelating agent, and a balance of an additional detergent builder.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENT

Figure 1:
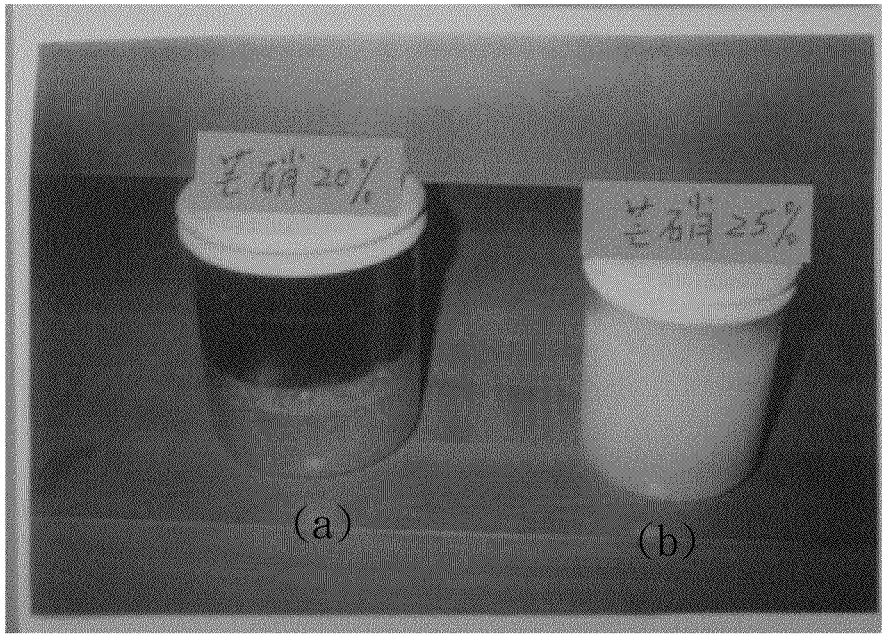
FIG. 1 is a photograph to illustrate a comparison of a cleaning effect on sludge oil between the detergent compositions of Example 1 of this invention and a comparative example.

The preferred embodiment of a detergent composition according to this invention includes: 11 to 45 parts by weight of a natural surfactant; 25 to 35 parts by weight of mirabilite; 10 to 40 parts by weight of a water softener; 0.1 to 5 parts by weight of a chelating agent; and a balance of an additional detergent builder.

Preferably, the natural surfactant is selected from the group consisting of coconut oil, coconut powders, hydrogenated castor oil, palm oil and combinations thereof. More preferably, the natural surfactant includes 5 to 20 parts by weight of coconut oil, 5 to 20 parts by weight of coconut powders and 1 to 5 parts by weight of hydrogenated castor oil. Particularly, coconut oil is tender and has antibacterial and skin-protecting effects. The natural surfactant has an excellent permeation effect so that molecular structures or the contaminants such as sludge oil or greasy dirt can be completely destroyed and so that the contaminants can be completely biodegraded in the discharged waste water.

Mirabilite, i.e., sodium sulphate decahydrate, conventionally is applied to the Chinese medicine field and used as a stool softener. After intensive research, the applicant found that mirabilite has relatively good water solubility and softening effect on hardened surfaces of contaminants, thereby assisting the natural surfactant to sufficiently permeate into the contaminant to achieve an improved cleaning effect.

Based on test results obtained from the applicant's substantial experimentation, an appropriate amount of mirabilite in combination with the natural surfactant can act against stubborn contaminants through high performance of emulsion and decomposition. When mirabilite is mixed with the natural surfactant in an appropriate ratio, for example, 11 to 45 parts by weight of the natural surfactant mixed with 25 to 35 parts by weight of mirabilite, the detergent composition thus formed will produce fine bubbles during a cleaning process and the fine bubbles are easily washed off so as to achieve great savings in water usage and superior biodegradability. However, if the amount of mirabilite is less than 25 parts by weight, a speed to soften the hardened surfaces of the contaminants is not sufficiently high and a satisfactory cleaning effect cannot be obtained. On the other hand, if the amount of mirabilite is greater than 35 parts by weight, a satisfactory speed to soften the hardened surfaces of the contaminants is obtained but the cleaning effect cannot be improved due to relatively low or insufficient amounts of other components.

Preferably, the water softener is sodium carbonate.

Preferably, the chelating agent is selected from an ecological chelating agent, such as disodium methylglycinediacetate (MGDA-$Na_3$). The ecological chelating agent is aimed at substituting for EDTA that is used in the conventional synthetic detergent and that seriously damages the environment and the ecology. According to the applicant's research, using disodium methylglycinediacetate (MGDA-3Na) as the ecological chelating agent may make chelating of the detergent composition of this invention with the heavy metal more complete, and may replace zeolite used in the conventional detergent to remove calcium ions present in hard water for avoiding production of calcium phosphate scale. Additionally, the biodegradability of disodium methyglycinediacetate is more than 80% within 28 days, and replacement of EDTA with disodium methylglycinediacetate not only improves heavy-metal removability of the detergent composition but decreases adverse effects of the detergent composition on the environment.

Preferably, the additional detergent builder includes 0.5 to 1.0 part by weight of methyl cellulose, 1 to 6 parts by weight of alkyl glucoside, 0.1 to 1.0 part by weight of sodium polyacrylate, 5 to 15 part by weight of sodium percarbonate, and 5 to 10 parts by weight of sodium metasilicate. More preferably, the additional detergent builder further includes 0.3 to 2 parts by weight of carboxymethyl cellulose, 3 to 10 parts by weight of glycerol, less than 250 ppm of chlorine dioxide, and 3 to 10 parts by weight of Neem oil.

Regarding the composition of the additional detergent builder, methyl cellulose is used for improving thickening and dispersity of a solution treated with the detergent composition of this invention. Alkyl glucoside is used for removing lime originating from tap water and avoiding occurrence of calcification. Sodium polyacrylate is used for enhancing softening of the tap water and thickening of the solution treated with the detergent composition. Since sodium polyacrylate is prepared from polymerization of acrylic acid and sodium acrylate and bears negative charges, a relatively high content of water can be absorbed to enhance moisture-retaining ability of the user's skin, and softening of the tap water can be enhanced to improve detergency of the detergent composition.

It is noted that the conventional synthetic detergent includes strong acidic or basic components and tends to damage the user's skin and cause skin problems such as drying and aging. By virtue of incorporating alkyl glucoside with sodium polyacrylate in the additional detergent builder, the detergent composition of this invention is mild and provides moisture-retaining property to the user's skin.

Sodium percarbonate and sodium metasilicate are used as bleaching agents. Carboxymethyl cellulose belongs to a food-grade additive and is used as a thickener. Glycerol is used for enhancing moisture-retaining and anti-freezing effects. Chlorine dioxide is used for enhancing antibacterial and antivirus effects due to its strong oxidizing power and has been recognized by the WHO as a safe and efficient A1-level disinfector and as the fourth generation of antibacterial agent. Neem oil used in this invention is a biodegradable and non-toxic antibacterial agent, having an excellent moisture-retaining effect, and can thus be used for treating skin diseases, such as eczema and skin allergy.

The advantages of this invention reside in using mirabilite for softening the hardened surfaces of the contaminants such as sludge oil or greasy dirt, and permitting the natural surfactant to penetrate the contaminants to complete cleaning. The detergent composition does not include components detrimental to the environment, such as formaldehyde, benzene, fluorescent, EDTA, nonyl phenol, heavy metal, etc., and has a biodegradability of more than 95%. Hence, the detergent composition of this invention is friendly to the environment and has a relatively good cleaning effect.

EXAMPLES

Example 1

10.0 parts by weight of coconut oil, 12.0 parts by weight of coconut powders, 2.3 parts by weight of hydrogenated caster oil, 1.0 part by weight of disodium methylglycinediacetate, 25.0 parts by weight of mirabilite, 0.7 part by weight of methyl cellulose, 2.5 parts by weight of alkyl glucoside, 0.5 parts by weight of sodium polyacrylate, 7.0 parts by weight of sodium percarbonate, 7.0 parts by weight of sodium metasilicate, and 32.0 parts by weight of sodium carbonate were mixed together to prepare the detergent composition of this example.

Example 2

10.0 parts by weight of coconut oil, 10.0 parts by weight of coconut powders, 1.3 parts by weight of hydrogenated caster oil, 1.0 part by weight f disodium methylglycinediacetate, 3.0 parts by weight of mirabilite, 0.5 part by weight of methyl cellulose, 2.0 parts by weight of alkyl glucoside, 0.2 part by weight of sodium polyacrylate, 6.0 parts by weight of sodium percarbonate, 6.0 parts by weight of sodium metasilicate, and 22.0 parts by weight of sodium carbonate were mixed to prepare a mixture. 1.0 parts by weight of methyl cellulose, 5.0 parts by weight of glycerol, 5.0 parts by weight of Neem oil, and 150 ppm of chlorine dioxide were added to the mixture to prepare the detergent composition of this example.

Example 3

The detergent composition of Example 3 has a composition similar to that of Example 2 except that the amount of mirabilite is 35.0 parts by weight.

Example 4

As shown in Table 1, the detergent composition of Example 4 includes constituent components similar to those of Example 1 but in different amounts and further includes 0.6 part by weight of sodium hexametaphosphate, 2.0 parts by weight of citraic acid, and 1.0 part by weight of butanedioic acid.

Comparative Example

The detergent composition of the comparative example has a composition similar to that of Example 2 except that the amount of mirabilite is decreased to 20.0 parts by weight and that the amounts of coconut powders, coconut oil and sodium carbonate are as shown in Table 1

TABLE 1

Composition Comparison between Examples 1~4 and Comparative Example

| Composition (parts by weight)*1 | Example 1 | Example 2 | Example 3 | Example 4 | Comparative Example |
|---|---|---|---|---|---|
| Coconut oil | 10.0 | 1030 | 10.0 | 12.0 | 12.0 |
| Coconut powders | 12.0 | 10.0 | 10.0 | 10.0 | 12.0 |
| Hydrogenated castor oil | 2.3 | 1.3 | 1.3 | 2.0 | 1.3 |
| Trisodium methylglycinediacetate | 1.0 | 1.0 | 1.0 | 0.4 | 1.0 |
| Mirabilite | 25.0 | 30.0 | 35.0 | 25.0 | 20.0 |
| Caboxymethyl cellulose | | 1.0 | 1.0 | | 1.0 |
| Methyl cellulose | 0.7 | 0.5 | 0.5 | 0.5 | 0.5 |
| Sodium polyacrylate | 0.5 | 0.2 | 0.2 | 0.5 | 0.2 |
| Glycerol | | 5.0 | 3.0 | | 5.0 |
| Sodium percarbonate | 7.0 | 6.0 | 6.0 | 5.0 | 6.0 |
| Sodium metasilicate | 7.0 | 6.0 | 6.0 | 5.0 | 6.0 |
| Sodium carbonate | 32.0 | 22.0 | 21.0 | 31.0 | 28.0 |
| Neem oil | | 5.0 | 3.0 | 2.0 | 5.0 |
| Alkyl glycoside | 2.5 | 2.0 | 2.0 | 3.0 | 2.0 |

TABLE 1-continued

Composition Comparison between Examples 1~4 and Comparative Example

| Composition (parts by weight)*1 | Example 1 | Example 2 | Example 3 | Example 4 | Comparative Example |
|---|---|---|---|---|---|
| Chlorine dioxide (ppm) | | 150 | 150 | | |
| Sodium hexametaphospate | | | | 0.6 | |
| Citric acid | | | | 2.0 | |
| Butanedioic acid | | | | 1.0 | |
| Total*2 | 100.0 | 100.0 | 100.0 | 100.0 | 100.0 |

*1all amounts of the constituent components are expressed in parts by weight except that the amount of chlorine dioxide is expressed in ppm.
*2the amount of chlorine dioxide is traced and rounded Cleaning Effect Test 1. Decomposition of Sludge Oil Two bottles of 500 ml were equally filled with 450 ml of sludge oil obtained from a wastewater treatment equipment of a restaurant. The detergent compositions of Example 1 and the comparative example were respectively added to the bottles. The two bottles were allowed to stand for one hour. Referring to FIG. 1(*a*), for the bottle treated with the detergent composition of the comparative example containing 20 parts by weight of mirabilite, a portion of the sludge oil was suspended in the emulsion of the sludge oil. Referring to FIG. 1(*b*), for the bottle treated with the detergent composition of Example 1 containing 25 parts by weight of mirabilite, the sludge oil was completely emulsified. This demonstrates that the detergent composition of this invention containing not less than 25 parts by weight of mirabilite has an improved cleaning effect on sludge oil.

2. Leather Article Cleaning

Sludge oil was equally spread over leather skin of two chairs. Then, the two chairs were wiped with the detergent compositions of the comparative example and the detergent composition of Example 2, respectively, so as to remove the sludge oil. It was found that part of the sludge oil of the leather skin of the chair treated with the detergent composition of the comparative example containing 20 parts by weight of mirabilite was left on the chair, and that the sludge oil of the leather skin of the chair treated with the detergent composition of Example 2 could be completely removed. This demonstrates that the detergent composition of this invention is useful for removing the sludge oil on leather articles.

3. Metal Article Cleaning

Figure 2:
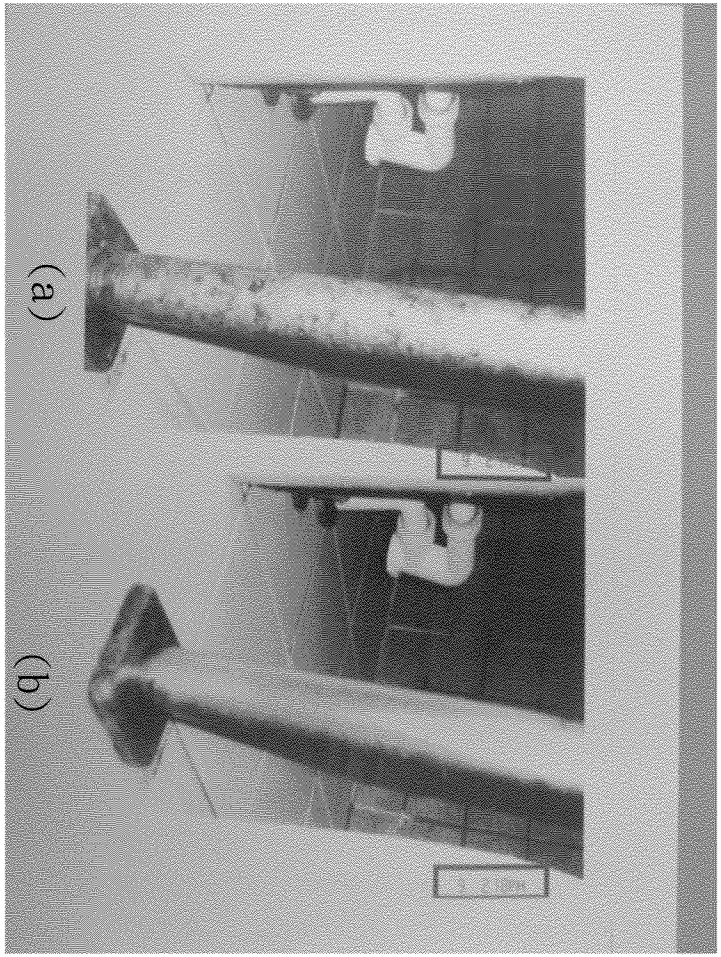
FIG. 2 is a photograph to illustrate a comparison of a cleaning effect on a rusty metal article between the detergent compositions of Example 2 of this invention and the comparative example.

Two rusty metal tubes were wiped with the detergent composition of Example 2 and the comparative example, respectively. Referring to FIG. 2(*a*), the rusty metal tube on the left was still covered with rust after being treated with the detergent composition of the comparative example, whereas referring to FIG. 2(*b*), the rusty metal tube on the right turned shiny after being treated with the detergent composition of Example 2. This demonstrates that the detergent composition of this invention is useful for cleaning metal articles in addition to leather articles.

4. Fabric Cleaning

Figure 3:
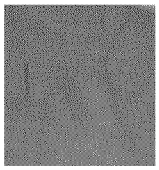
FIG. 3 is a photograph to illustrate a comparison of a cleaning effect on a fabric cloth stained with soybean oil and soybean sauce among the detergent compositions of Examples 1~3 of this invention and the comparative example.
Figure 3:
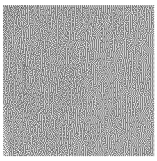
Figure 3:
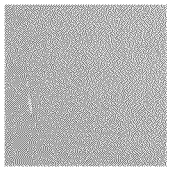
Figure 3:
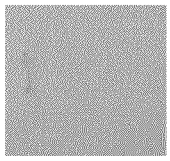

Four pieces of white fabric cloths were contaminated by soaking with a liquid mixture of 10 cc of soybean sauce and 10 cc of soybean oil. 10 ml of the detergent compositions of Examples 1~3 and 10 ml of the comparative example were respectively diluted with water to a final volume of 40 ml. The four pieces of the contaminated fabric cloths were respectively washed using the diluted detergent compositions of the Examples 1~3 and the comparative example. After washing for 30 seconds, the cleaning effect of each detergent composition is shown in FIG. 3. As shown in FIG. 3(*a*), the fabric cloth washed using the detergent composition of the comparative example ahs a color darker than other fabric cloths washed using the detergent compositions of the Examples of this invention (see FIGS. 3(*b*)~(*d*)). This means that the soybean source and the soybean oil have penetrated into the fibers of the fabric cloth washed using the detergent composition of the comparative example and are hardly cleaned. This test demonstrated that the detergent compositions of the Examples of this invention are superior in cleaning the fabric cloths than the comparative example. Besides, the more the amount of mirabilite increases the better the cleaning effect on the fabric cloth will be. When the amount of mirabilite in the detergent composition reached at least 30 parts by weight, the condition of the fabric cloth after being treated is almost the same as the original condition of the fabric cloth before being soaked in the mixture of the soybean sauce and the soybean oil.

According to the results of the abovementioned cleaning tests, by means of using a specified range of amount of mirabilite for softening the hardened surfaces of the contaminants such as sludge oil or greasy dirt, and of permitting the natural surfactant to penetrate the contaminants for a complete clean, the detergent composition of this invention does not include components detrimental to the environment, such as formaldehyde, benzene, fluorescent, EDTA, nonyl phenol, heavy metal, etc., and has a biodegradability of more than 95%. Hence, the detergent composition of this invention is friendly to the environment and has a relatively good cleaning effect.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A detergent composition, comprising:
11 to 45 parts by weight of a natural surfactant;
25 to 35 parts by weight of mirabilite;
10 to 40 parts by weight of a water softener;
0.1 to 5 parts by weight of a chelating agent; and
a balance of an additional detergent builder.

2. The detergent composition of claim 1, wherein the natural surfactant is selected from the group consisting of coconut oil, coconut powders, hydrogenated castor oil, palm oil and combinations thereof.

3. The detergent composition of claim 2, wherein the natural surfactant includes 5 to 20 parts by weight of coconut oil, 5 to 20 parts by weight of coconut powders and 1 to 5 parts by weight of hydrogenated castor oil.

4. The detergent composition of claim 1, wherein the water softener is sodium carbonate.

5. The detergent composition of claim 1, wherein the chelating agent is disodium methylglycinediacetate.

6. The detergent composition of claim 1, wherein the additional detergent builder includes 0.5 to 1.0 part by weight of methyl cellulose, 1 to 6 parts by weight of alkyl glucoside, 0.1 to 1.0 parts by weight of sodium polyacrylate, 5 to 10 parts by weight of sodium percarbonate, and 5 to 10 parts by weight of sodium metasilicate.

7. The detergent composition of claim 6, wherein the additional detergent builder further includes 0.3 to 2 parts by weight of carboxymethyl cellulose, 3 to 10 parts by weight of glycerol, less than 250 ppm of chlorine dioxide, and 3 to 10 parts by weight of Neem oil.

* * * * *